US005685458A

United States Patent [19]

Durham et al.

[11] Patent Number: 5,685,458

[45] Date of Patent: Nov. 11, 1997

[54] DISPENSING VALVE QUICK CONNECT INTERFACES INCLUDING A NON-CARBONATED BEVERAGE BRIDGE

[75] Inventors: Samuel Durham; David A. Renaud, both of San Antonio, Tex.; Theresa M. Jackson, Vinings, Ga.; Paul A. Phillips, Marietta, Ga.; W. David Vinson, Peachtree City, Ga.

[73] Assignee: The Coca-Cola Company, Atlanta, Ga.

[21] Appl. No.: 582,970

[22] Filed: Jan. 4, 1996

[51] Int. Cl.[6] ..... B67D 5/56

[52] U.S. Cl. ..... 222/129.1

[58] Field of Search ..... 222/129.1–129.4

[56] References Cited

U.S. PATENT DOCUMENTS

| | | | |
|---|---|---|---|
| 3,902,636 | 9/1975 | Zilk | 222/129.1 |
| 4,535,917 | 8/1985 | Trewhella | 222/129.1 |

OTHER PUBLICATIONS

300–Q Manifolds Brochure, Flomatic International, 1995, 5924 SE 47th Avenue, Portland, Oregon 97206.

*Primary Examiner*—Gregory L. Huson

*Attorney, Agent, or Firm*—Dennis W. Braswell

[57] ABSTRACT

An apparatus permits a drink dispensing system to dispense more than one non-carbonated beverage. The drink dispensing system includes a housing supporting dispensing valves, a syrup source communicating through syrup lines, and a water source communicating through a water line. The apparatus includes first and second interfaces mounted onto the housing. A bridge connects the first interface with the second interface to permit the water line to service dispensing valves mounted on both the first and second interfaces. The bridge includes a telescoping feature that facilitates variable spacing between the first and second interfaces.

1 Claim, 5 Drawing Sheets

DISPENSING VALVE QUICK CONNECT INTERFACES INCLUDING A NON-CARBONATED BEVERAGE BRIDGE

BACKGROUND OF THE INVENTION

1. Field of the Invention

The present invention relates to drink dispensing systems and, more particularly, but not by way of limitation, to dispensing valve quick connect interfaces including a non-carbonated beverage bridge.

2. Description of the Related Art

Certain drink dispensing systems include a design that permits the dispensing of multiple carbonated soda beverages and one non-carbonated juice beverage. The carbonated soda beverages are formed through the mixing of soda syrups with carbonated water and the non-carbonated juice beverage is formed through the mixing of a juice syrup with plain water.

These drink dispensing systems include a housing that contains a cooling device, such as a cold plate or refrigeration unit, utilized to chill the soda syrup, carbonated water, juice syrup, and plain water prior to dispensing. The housing further contains pumps connected between soda syrup sources and soda syrup inlets into the cooling device and a pump connected between each of a carbonated water source, juice syrup source, and a plain water source and respective inlets into the cooling device. The cooling device includes soda syrup outlets connected to carbonated beverage interfaces mounted on the housing and a carbonated water outlet connected to a manifold which, in turn, connects to the carbonated beverage interfaces. The cooling device further includes a juice syrup outlet connected to a non-carbonated beverage interface mounted on the housing and a plain water outlet also connected to the non-carbonated beverage interface.

Dispensing valves mount to each carbonated beverage interface and to the non-carbonated beverage interface to facilitate the dispensing of the carbonated and non-carbonated beverages. The activation of a dispensing valve actuates associated pumps, either a soda syrup pump and the carbonated water pump or the juice syrup and plain water pumps, which deliver the appropriate syrup and mixing fluid.

The above-described drink dispensing system design including multiple carbonated beverages and one non-carbonated beverage operates adequately, except there has been a recent demand in the drink dispensing industry for the dispensing of a second non-carbonated beverage. Unfortunately, the configuration of these drink dispensing systems, primarily the dispensing valve interfaces and carbonated water manifold, is not suitable for the addition of a second non-carbonated beverage. Thus, an owner of such a drink dispensing system currently has the option of either purchasing a new drink dispensing system or paying for the costly replacement of the carbonated beverage manifold and addition of a second plain water line. These two options are economically unacceptable; consequently, an apparatus that permits the cost-effective addition of a second non-carbonated beverage to existing drink dispensing systems that presently dispense multiple carbonated beverages and one non-carbonated beverage is an improvement necessary in the drink dispensing industry.

SUMMARY OF THE INVENTION

In accordance with the present invention, an apparatus permits a drink dispensing system to dispense more than one non-carbonated beverage. The drink dispensing system includes a housing supporting dispensing valves, a syrup source communicating through syrup lines, and a water source communicating through a water line.

The apparatus includes a first interface mounted onto the housing. The first interface includes a syrup port having an inlet connected to a syrup line and an outlet connected to a dispensing valve. The first interface further includes a water port having an inlet connected to the water line, an outlet connected to the dispensing valve, and a conduit.

The apparatus includes a second interface mounted onto the housing. The second interface includes a syrup port having an inlet connected to a syrup line and an outlet connected to a dispensing valve. The second interface further includes a water port having an outlet connected to the dispensing valve and a conduit.

The apparatus includes a bridge that connects the water port of the first interface to the water port of the second interface. The bridge includes a first conduit connected to the conduit of the water port of the first interface and a second conduit connected to the conduit of the water port of the second interface. The second conduit connects to and telescopes within the first conduit to facilitate variable spacing between the first and second interfaces.

It is therefore an object of the present invention to provide an apparatus that permits the addition of a second non-carbonated beverage without the redesign of existing drink dispensing systems.

It is another object of the present invention to bridge a first dispensing valve interface with a second dispensing valve interface to permit a single water line to supply two dispensing valves.

It is further object of the present invention to provide the bridge between the first dispensing valve interface and the second dispensing valve interface with a telescoping feature that facilitates variable spacing between the first and second interfaces.

Still other objects, features, and advantages of the present invention will become evident to those skilled in the art in light of the following.

DETAILED DESCRIPTION OF THE PREFERRED EMBODIMENT

Figure 1:
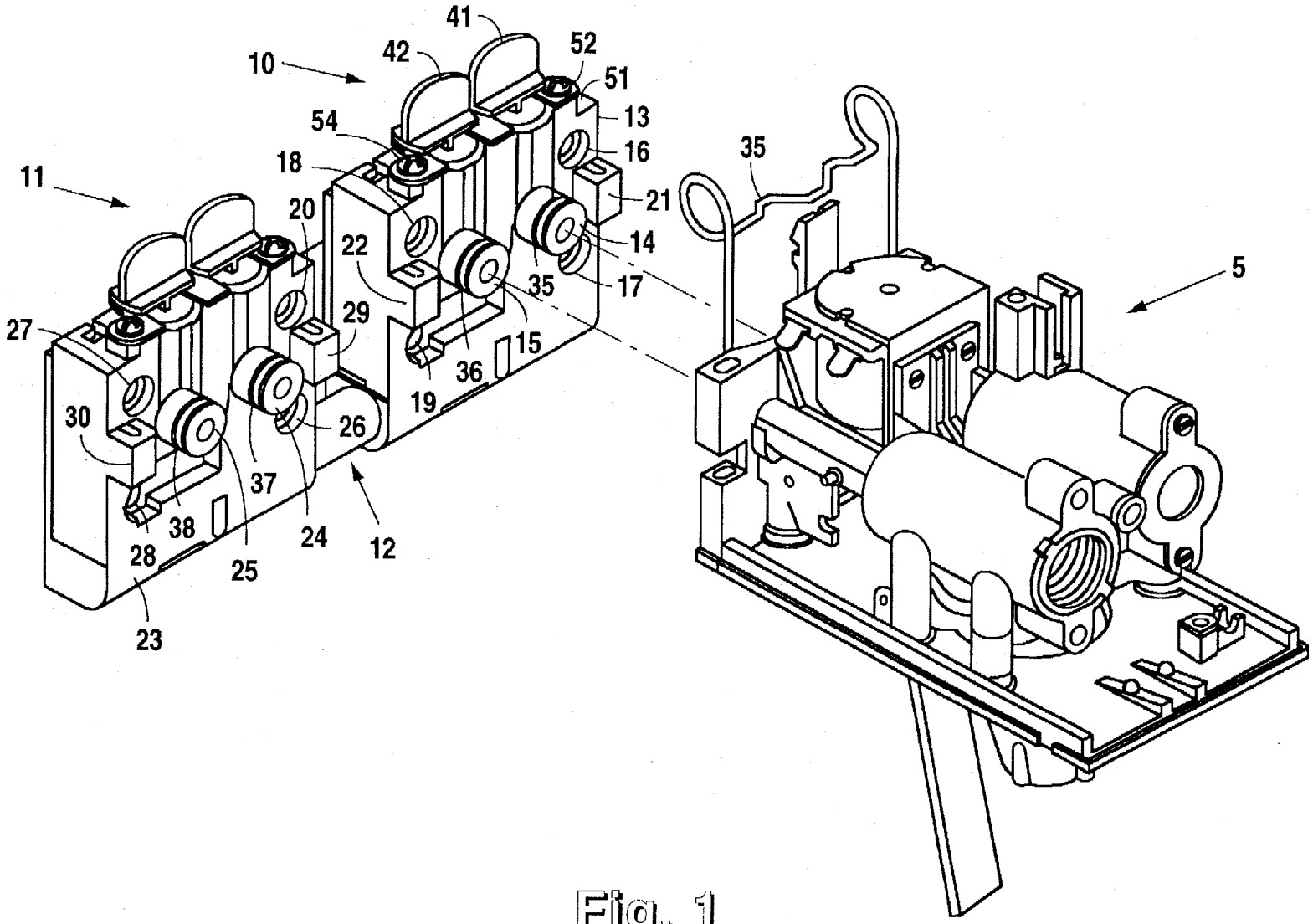
FIG. 1 is a perspective view illustrating a dispensing valve and the front of quick connect interfaces including a non-carbonated beverage bridge.
Figure 2:
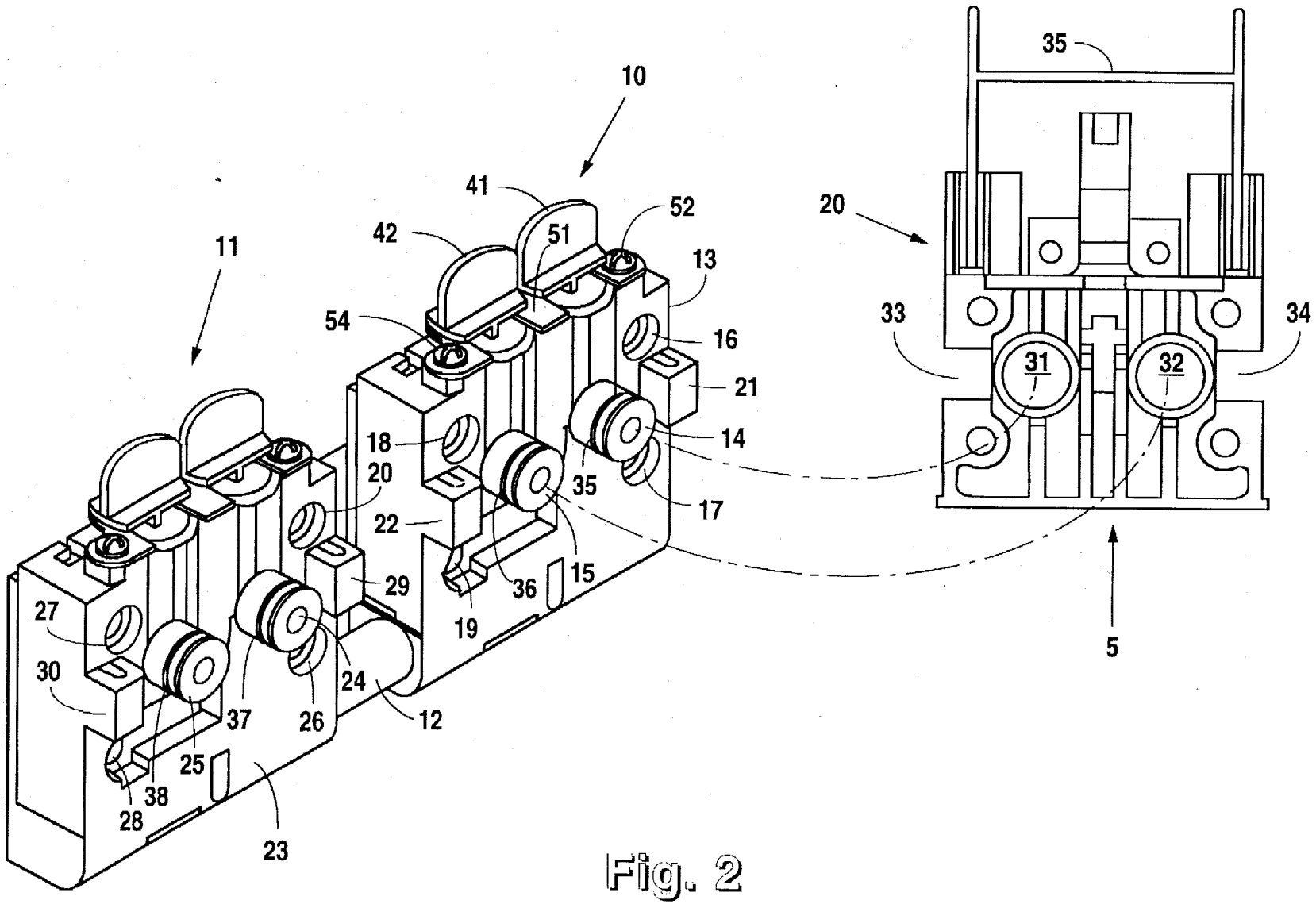
FIG. 2 is a perspective view illustrating the rear of the dispensing valve and the front of the quick connect interfaces including the non-carbonated beverage bridge.

As illustrated in FIGS. 1 and 2, quick connect interfaces 10 and 11 are connected via bridge 12. Quick connect interface 10 includes housing 13 which, in turn, includes ports 14 and 15. Ports 14 and 15 extend completely through housing 13 to provide passageways that permit communication between the front and rear of quick connect interface 10. Housing 13 includes protrusions 21 and 22 which aid ports 14 and 15 in supporting dispensing valve 5 on housing 13. In this preferred embodiment, dispensing valve 5 is any suitable dispensing valve such as those manufactured by Lancer Corporation which has a business address of 235 W. Turbo, San Antonio, Tex. 78216.

Housing 13 includes holes 16–19 extending therethrough to permit the mounting of housing 13 onto the front of a face plate of a drink dispensing system so that quick connect interface 10 will support dispensing valve 5. Housing 13 may be mounted within a beverage dispensing system using any suitable means however, in this preferred embodiment, screws are placed within holes 16–19 and threadably secured to the front of a face plate within the drink dispensing system. Holes 16–19 include a recessed portion in the front of housing 13 so that the heads of the screws utilized to secure housing 13 to the face plate do not interfere with the mounting of dispensing valve 5.

Quick connect interface 11 includes housing 23 which, in turn, includes ports 24 and 25. Ports 24 and 25 extend completely through housing 23 to provide passageways that permit communication between the front and rear of quick connect interface 11. Housing 23 further protrusions 29 and 30 which aid ports 24 and 25 in supporting a dispensing valve 5 on housing 23.

Housing 23 includes holes 20 and 26–28 extending therethrough to permit the mounting of housing 23 onto the front of a face plate of a drink dispensing system so that quick connect interface 11 will support a dispensing valve (not shown) identical to dispensing valve 5. Housing 23 may be mounted within a beverage dispensing system using any suitable means however, in this preferred embodiment, screws are placed within holes 20 and 26–28 and threadably secured to the front of a face plate within the drink dispensing system. Holes 20 and 26–28 include a recessed portion in the front of housing 23 so that the heads of the screws utilized to secure housing 23 to the face plate do not interfere with the mounting of the dispensing valve.

Dispensing valve 5 slides easily onto housing 13 and mounts thereon without the use of connection devices such as threaded fittings and/or clamps. No connection devices are required because dispensing valve 5 includes cavities 31 and 32, slots 33 and 34, and pin 35. Ports 14 and 15 fit within cavities 31 and 32, respectively, while protrusions 21 and 22 slide into slots 33 and 34, respectively. Pin 35 drops into the cavities within protrusions 21 and 22 to firmly secure dispensing valve 5 onto housing 13. Furthermore, ports 14 and 15 each include a respective groove 35 and 36 that receives an O-ring that prevents the leakage of either syrup or plain water. Cavities 31 and 32 of dispensing valve 5 not only provide a mounting point but also communicate with a mixing chamber to permit the inlet of syrup and plain water into dispensing valve 5.

A dispensing valve identical to dispensing valve 5 mounts to housing 23. Ports 24 and 25 fit within the cavities of the dispensing valve, while protrusions 29 and 30 slide into the slots of the dispensing valve. The pin of the dispensing valve drops into the cavities within protrusions 29 and 30 to firmly secure the dispensing valve onto housing 23. Furthermore, ports 24 and 25 each include a respective groove 37 and 38 that receives an O-ring that prevents the leakage of either syrup or plain water.

Figure 3:
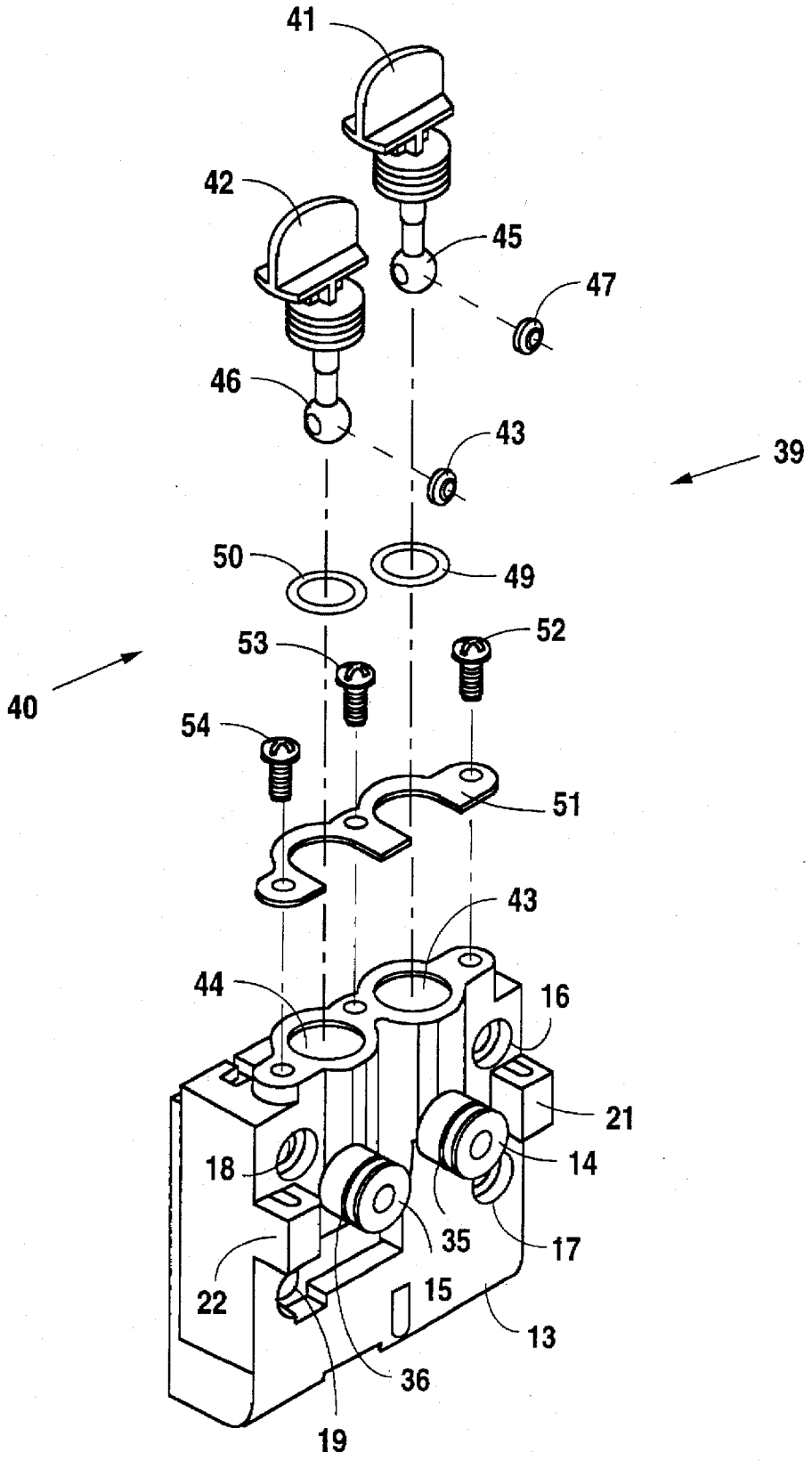
FIG. 3 is an exploded perspective view of the quick connect interfaces including the non-carbonated beverage bridge.

As illustrated in FIG. 3, quick connect interface 10 includes flow controllers 39 and 40 to prevent the leakage of syrup and plain when dispensing valve 5 is removed from the drink dispensing system. The flow controllers of quick connect interface 11 are identical to flow controllers 39 and 40 and, therefore, will not be described. Flow controllers 39 and 40 include valves 41 and 42, respectively. Housing 13 includes channels 43 and 44 that communicate with ports 14 and 15, respectively, to permit the placement of valve 41 within port 14 and valve 42 within port 15. Valve 41 fits within channel 43 such that flow control ball 45 resides within the passageway through port 14. Similarly, valve 42 fits within channel 44 such that flow control ball 46 resides within the passageway through port 15.

Flow controllers 39 and 40 include washers 47 and 48 that reside within the passageways through ports 14 and 15, respectively, to provide a seat for flow control balls 45 and 46, respectively. Flow controllers 39 and 40 further include O-rings 49 and 50 that fit around valves 41 and 42, respectively, to hold valves 41 and 42 within their respective channels 43 and 44 and provide a fluid seal. After valves 41 and 42 have been placed in their respective channels 43 and 44, retainer 51 is connected to housing 13 using screws 52–54 to prevent the removal of valves 41 and 42.

Flow controllers 39 and 40 prevent the leakage of syrup and plain water when dispensing valve 5 is removed from quick connect interface 10 by allowing the sealing of port 14 and 15. Specifically, when dispensing valve 5 resides on quick connect interface 10, valves 41 and 42 are placed in the position parallel to ports 14 and 15 to align the passages through flow control balls 45 and 46 with the passageways through ports 14 and 15, respectively. Consequently, the flow of syrup and plain water through quick connect interface occurs. However, to prevent flow, valves 41 and 42 are rotated approximately one quarter of a turn to the position shown in FIGS. 1 and 2. That turn pivots the passage through each of flow control balls 45 and 45 out of alignment with the passageways through ports 14 and 15, respectively, thereby sealing those ports and preventing the flow of syrup and plain water.

Figure 4:
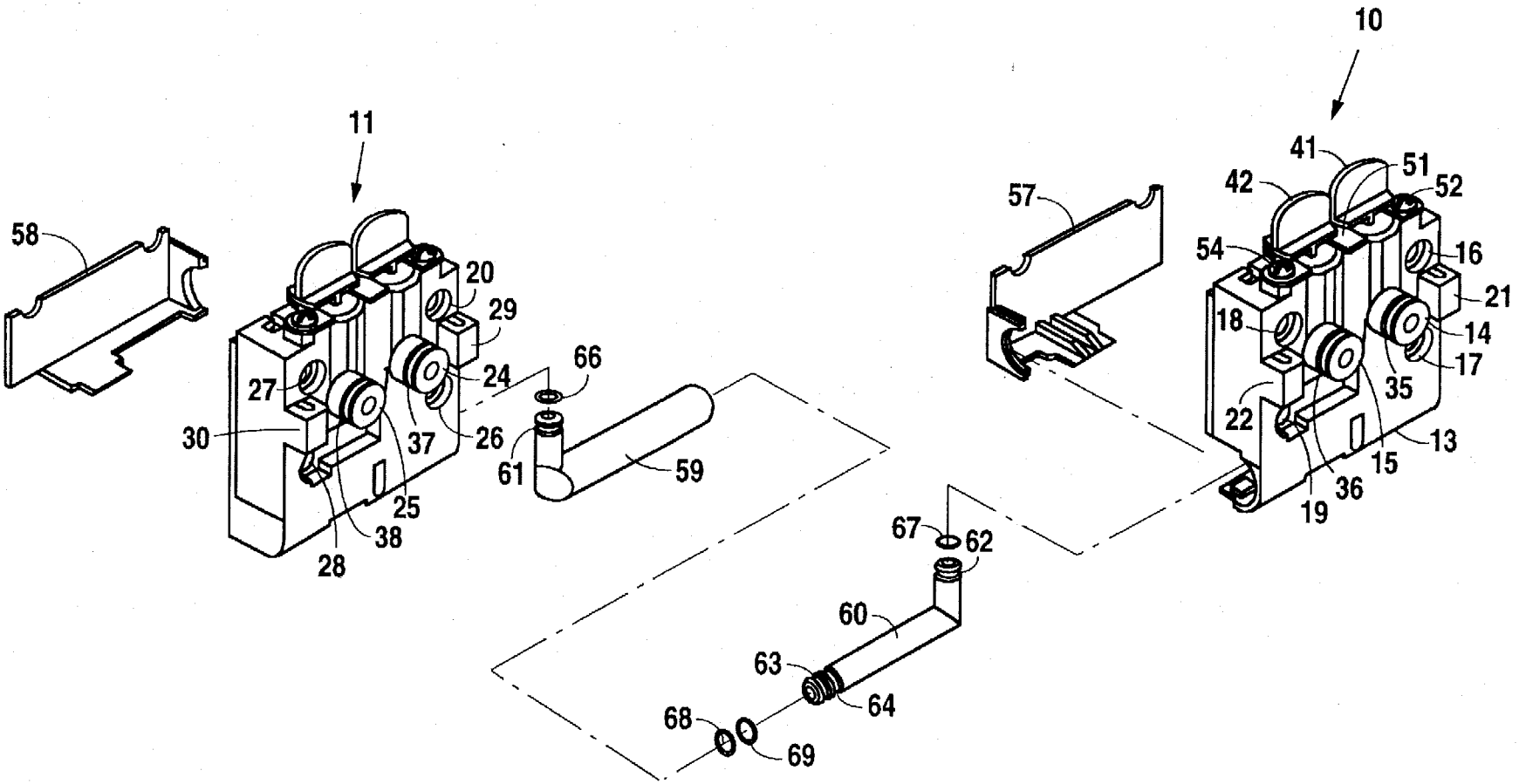
FIG. 4 is an exploded perspective view of the quick connect interfaces including the non-carbonated beverage bridge.
Figure 5:
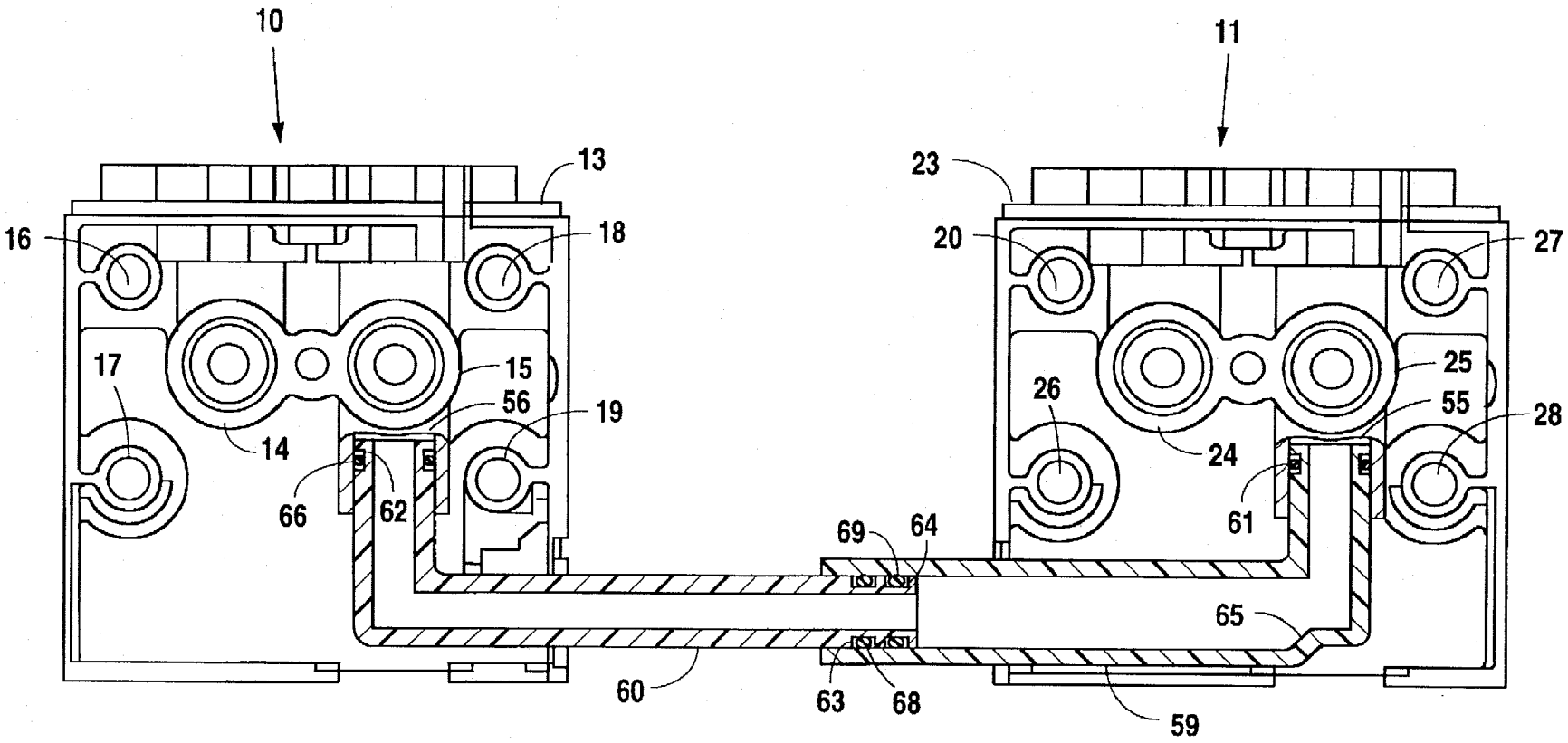
FIG. 5 is a perspective view illustrating the rear of the quick connect interfaces including the non-carbonated beverage bridge.

As illustrated in FIGS. 4 and 5, the inlet into port 25 receives plain water from a water line, while the inlet into port 15 is sealed. Each inlet of ports 24 and 14 receives syrup from a syrup line. Ports 25 and 15 include conduits 55 and 56, respectively, to permit the communication of plain water from port 25 to port 15 via bridge 12. Thus, bridge 12 permits a single water line to supply plain water to the dispensing valves connected to both quick connect interfaces 10 and 11. Furthermore, product may be dispensed from dispensing valve 5 even though quick connect interface 11 is shut off because plain water will flow through bridge 12 regardless of the position of the flow controller of quick connect interface 11. Additionally, quick connect interfaces 10 and 11 include a respective brace 57 and 58 to secure bridge 12 so that it does not move after the mounting of quick connect interfaces 10 and 11 to the face plate of the drink dispensing system.

Bridge 12 includes conduits 59 and 60 which fit within conduits 55 and 56, respectively, to permit the flow of plain water from port 25 to port 15. The inner diameters of conduits 55 and 56 are substantially equal to the outer diameters of conduits 59 and 60, respectively, so that conduits 59 and 60 will slide therein with a minimum tolerance. The inlet of conduit 59 includes groove 61 that receives O-ring 66 therein. O-ring 66 provides a fluid seal that prevents leakage of plain water from the interface between conduit 55 and conduit 59. Similarly, the outlet of conduit 60 includes groove 62 that receives O-ring 67 therein. O-ring 67 provides a fluid seal that prevents leakage of plain water from the interface between conduit 56 and conduit 60.

The inner diameter of conduit 59 is substantially equal to the outer diameter of conduit 60 so that conduit 60 will slide therein with a minimum tolerance. The inlet of conduit 60 includes grooves 63 and 64 that receive a respective O-ring 68 and 69 therein. O-rings 68 and 69 provide a fluid seal that prevents leakage of plain water from the interface between conduit 59 and conduit 60. The length of conduit 60 is sufficient to permit its insertion into conduit 59 such that its inlet contacts step 65 within conduit 59. The length of conduit 60 therefore permits its telescoping within conduit 59 between the minimum insertion distance illustrated in FIG. 5 and a maximum insertion distance wherein its inlet contacts step 65. Conduit 60 telescopes within conduit 59 to permit variable spacing between quick connect interface 10 and quick connect interface 11. Variable spacing is required because different size dispensing valves will have inlets at different locations that can be accommodated only by changing the relative positions of quick connect interfaces 10 and 11.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

We claim:

1. An apparatus for use within a drink dispensing system to permit the dispensing of more than one non-carbonated beverage wherein said drink dispensing system comprises a housing supporting dispensing valves, a syrup source communicating through syrup lines, and a water source communicating through a water line, comprising:

a first interface mountable on the housing, said first interface including a syrup port having an inlet connected to a syrup line and an outlet connected to a dispensing valve and a water port having an inlet connected to the water line, an outlet connected to the dispensing valve, and a conduit;

a second interface mountable on the housing, said second interface including a syrup port having an inlet connected to a syrup line and an outlet connected to a dispensing valve and a water port having an outlet connected to the dispensing valve and a conduit; and a bridge connecting said water port of said first interface to said water port of said second interface, said bridge comprising a first conduit connected to the conduit of said water port of said first interface and a second conduit connected to the conduit of said water port of said second interface wherein said second conduit connects to and telescopes within said first conduit to facilitate variable spacing between said first and second interfaces.

* * * * *